US008667760B2

(12) United States Patent
Drew

(10) Patent No.: US 8,667,760 B2
(45) Date of Patent: Mar. 11, 2014

(54) MODULAR BUILDING BLOCKS WITH INTERLOCKING REINFORCEMENT RODS

(75) Inventor: James Joseph Drew, Richmond (CA)

(73) Assignee: Coobs Canada Ltd., Richmond (CA)

( * ) Notice: Subject to any disclaimer, the term of this patent is extended or adjusted under 35 U.S.C. 154(b) by 0 days.

(21) Appl. No.: 13/481,708

(22) Filed: May 25, 2012

(65) Prior Publication Data

US 2012/0324820 A1 Dec. 27, 2012

Related U.S. Application Data

(60) Provisional application No. 61/491,130, filed on May 27, 2011.

(51) Int. Cl.
*E04C 2/04* (2006.01)

(52) U.S. Cl.
USPC ..... 52/600

(58) Field of Classification Search
USPC ..... 52/600, 602, 603, 604, 605, 606, 607
See application file for complete search history.

(56) References Cited

U.S. PATENT DOCUMENTS

| | | | | |
|---|---|---|---|---|
| 1,385,606 | A | 7/1921 | Christensen | |
| 2,929,236 | A | 3/1960 | Steward at al. | |
| 3,382,632 | A | 5/1968 | Grofesik | |
| 3,782,061 | A | 1/1974 | Minutoli et al. | |
| 4,726,567 | A * | 2/1988 | Greenberg | 256/19 |
| 5,355,647 | A | 10/1994 | Johnson et al. | |
| 5,899,040 | A * | 5/1999 | Cerrato | 52/604 |
| 6,244,009 | B1 * | 6/2001 | Cerrato | 52/604 |
| 6,758,020 | B2 | 7/2004 | Cerrato | |
| 6,871,453 | B2 | 3/2005 | Locke | |
| 6,931,797 | B2 | 8/2005 | Drew | |
| 6,957,518 | B1 * | 10/2005 | Koch, Jr. | 52/849 |
| 7,117,647 | B2 * | 10/2006 | Clarke | 52/233 |
| 8,061,095 | B2 | 11/2011 | Bucheger | |
| 2004/0020145 | A1 * | 2/2004 | Matsufuji | 52/223.7 |
| 2005/0252118 | A1 * | 11/2005 | Matsufuji | 52/223.7 |
| 2006/0288656 | A1 * | 12/2006 | Clarke | 52/233 |
| 2007/0056235 | A1 * | 3/2007 | Kohler | 52/223.7 |
| 2009/0090069 | A1 * | 4/2009 | Willis | 52/79.12 |

* cited by examiner

*Primary Examiner* — Mark Wendell
*Assistant Examiner* — Keith Minter
(74) *Attorney, Agent, or Firm* — Cameron IP

(57) ABSTRACT

A modular building block has a first load-bearing surface with a key. There is a recess in the key. The recess has a shoulder disposed therein and side walls extending from the shoulder to a mouth thereof. A reinforcement rod extends into the recess and a coupling for connecting vertically aligned reinforcement rods is disposed in the recess. The reinforcement rod threadedly engages the coupling. A locking plate engages the coupling to prevent the coupling from rotating relative to the locking plate. The locking plate sits on the shoulder and rotation of the locking plate within the recess is prevented by the side walls of the recess.

13 Claims, 8 Drawing Sheets

MODULAR BUILDING BLOCKS WITH INTERLOCKING REINFORCEMENT RODS

CROSS-REFERENCE TO RELATED APPLICATION

This application claims the benefit of provisional application 61/491,130 filed in the United States Patent and Trademark Office on May 27, 2011, the disclosure of which is incorporated herein by reference and priority to which is claimed.

BACKGROUND OF THE INVENTION

1. Field of the Invention

The present invention relates to modular building blocks and, in particular, to modular building blocks provided with interlocking reinforcement rods.

2. Description of the Related Art

It is known to provide modular building blocks with interlocking reinforcement rods. For example, U.S. Pat. No. 8,061,095 which issued on Nov. 22, 2011 to Bucheger discloses modular blocks provided with keys and keyways to allow for engagement of the blocks. The blocks are also provided with a vertical passageway through which reinforcement rods extend. Couplings are used to connect vertically aligned reinforcement rods. However, known modular building blocks with interlocking reinforcement rods are generally not provided with means to prevent rotation of the couplings. This may be problematic in cases where the couplings and reinforcement rods are threadedly connected. Rotation of couplings may result in the couplings and reinforcement rods coming unthreaded and the reinforcement capacity of the reinforcement rods being diminished.

SUMMARY OF THE INVENTION

It is an object of the present invention to provide an improved modular building block with a reinforcement rod.

It is also an object of the present invention to provide an improved locking assembly for connecting vertically aligned reinforcement rods of inter-engaged modular building blocks.

There is accordingly provided a modular building block comprising a first load-bearing surface having a key. There is a recess in the key. The recess has a shoulder disposed therein and side walls extending from the shoulder to a mouth thereof. A reinforcement rod extends into the recess and a coupling for connecting vertically aligned reinforcement rods is disposed in the recess. The reinforcement rod threadedly engages the coupling. A locking plate engages the coupling to prevent the coupling from rotating relative to the locking plate. The locking plate is shaped to sit on the shoulder so that rotation of the locking plate within the recess is prevented by the side walls of the recess.

There may be a second load-bearing surface having a keyway. The reinforcement rod may also extend into the keyway. There may be a hollow extending between the keyway and the recess in the key. The reinforcement rod may extend through the hollow. There may be a sleeve in the hollow. The reinforcement rod may extend through the sleeve in the hollow. There may be waterproof grease in the sleeve.

The shoulder may be a perimeter of a polygon. The locking plate may be a polygon having the same number of sides as the shoulder. For example, the shoulder may be square and the locking plate may be square. The locking plate may include a central opening for receiving the coupling. The coupling may be a polyhedron with a threaded aperture extending longitudinally therethrough and the central opening in the locking plate may be a polygonal opening having the same number of sides as the coupling. For example, the coupling may be a hexahedron and the central opening in the locking plate may be a hexagon. There may be a peripheral opening in the locking plate.

There is also provided a structure constructed from the improved modular building block disclosed herein.

BRIEF DESCRIPTIONS OF DRAWINGS

The invention will be more readily understood from the following description of the embodiments thereof given, by way of example only, with reference to the accompanying drawings, in which.

DESCRIPTIONS OF THE PREFERRED EMBODIMENTS

Figure 1:
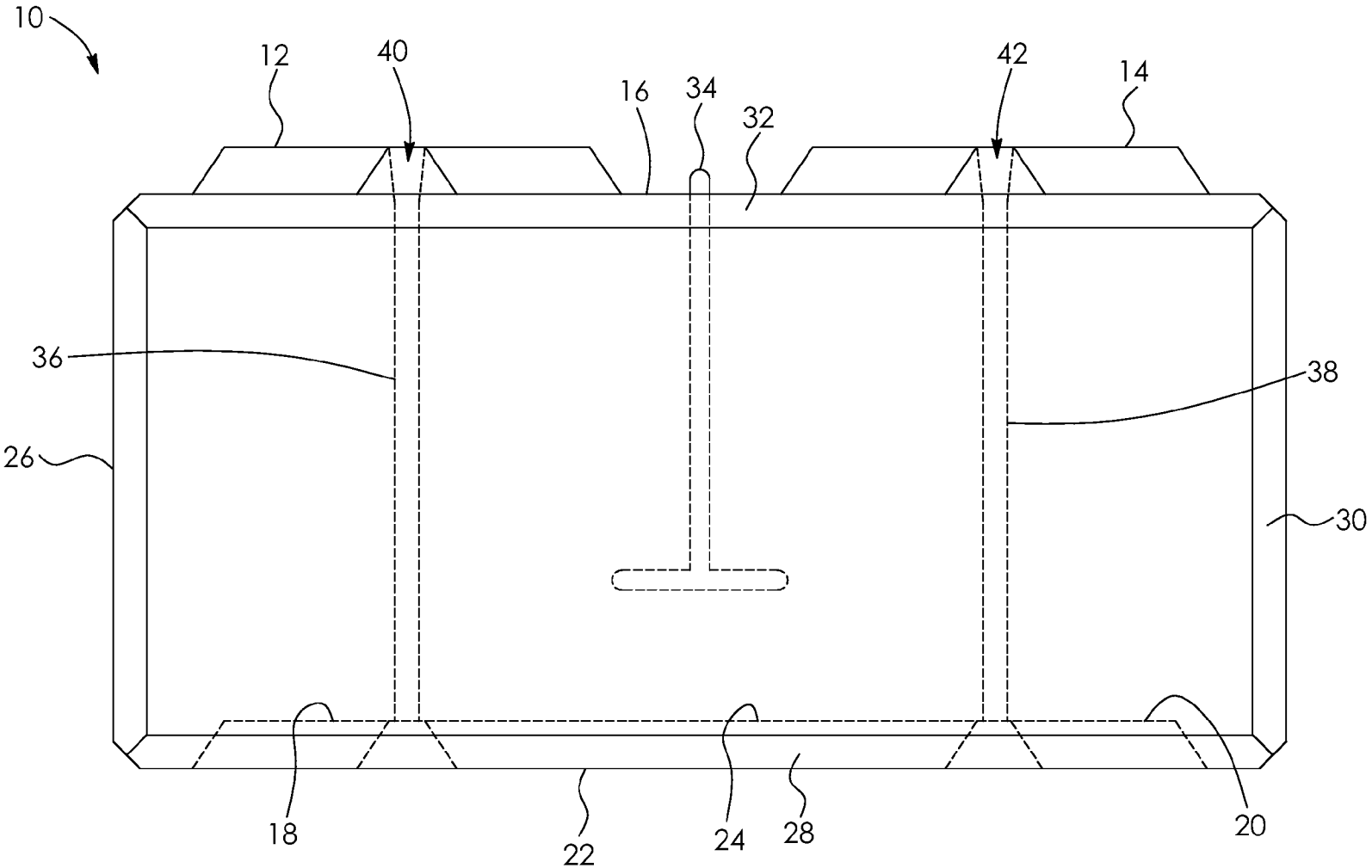
FIG. 1 is a side elevation view of an improved modular building block.
Figure 2:
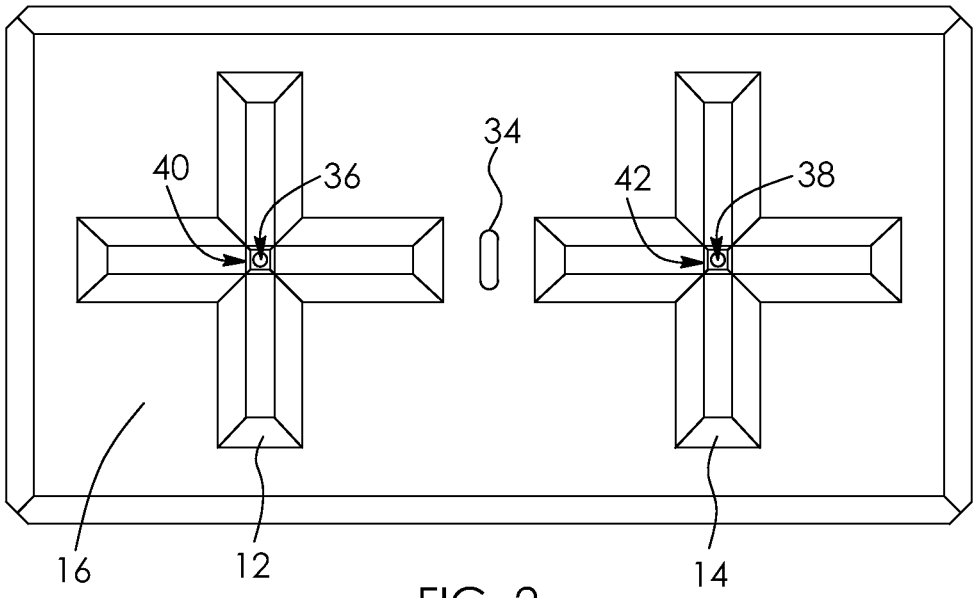
FIG. 2 is a top view of the modular building block of FIG. 1.
Figure 3:
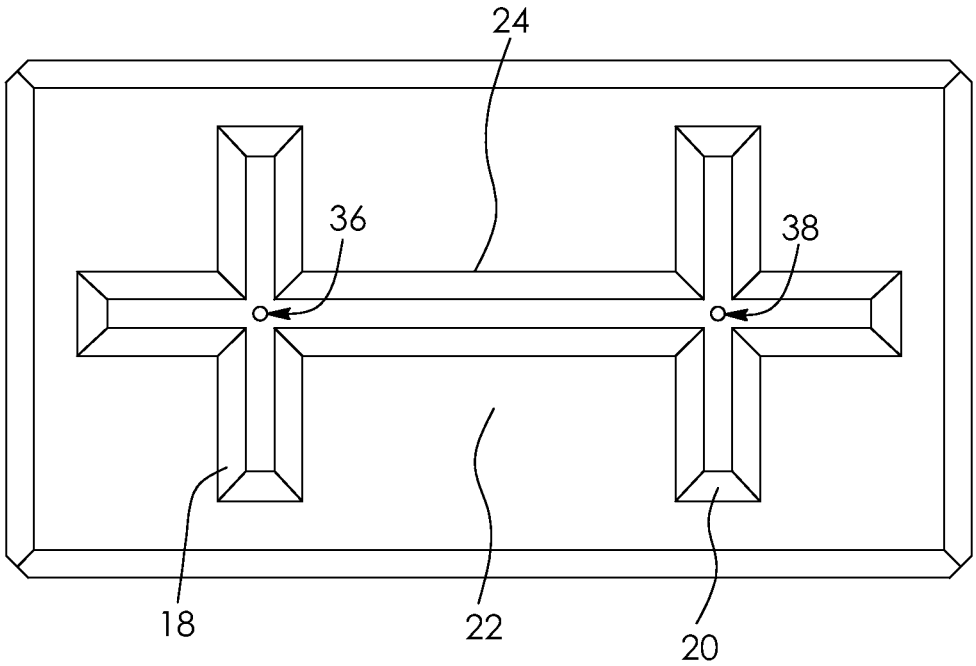
FIG. 3 is a bottom view of the modular building block of FIG. 1.
Figure 4:
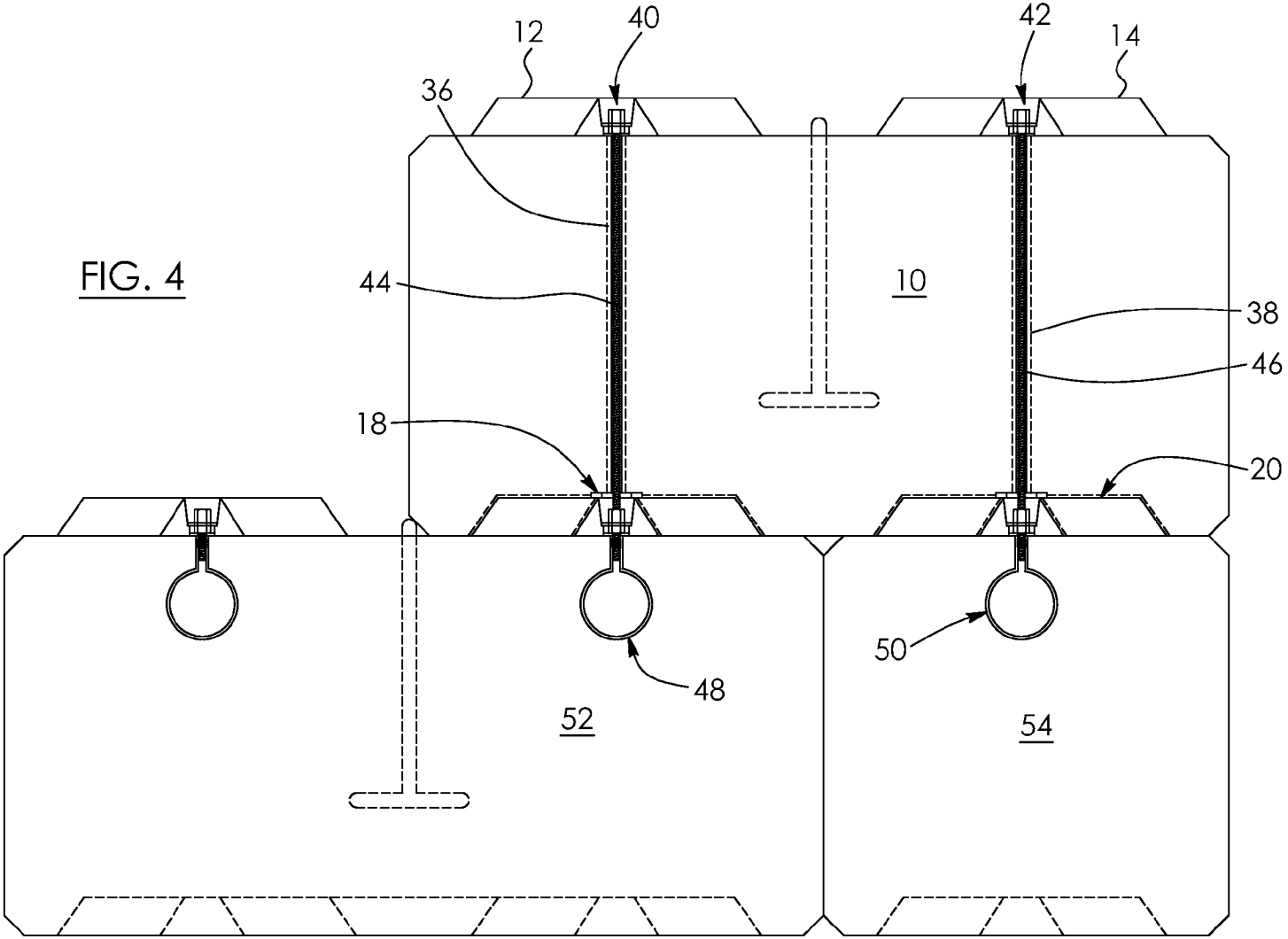
FIG. 4 is a sectional view showing the modular building block of FIG. 1 in a second course of a structure.
Figure 5:
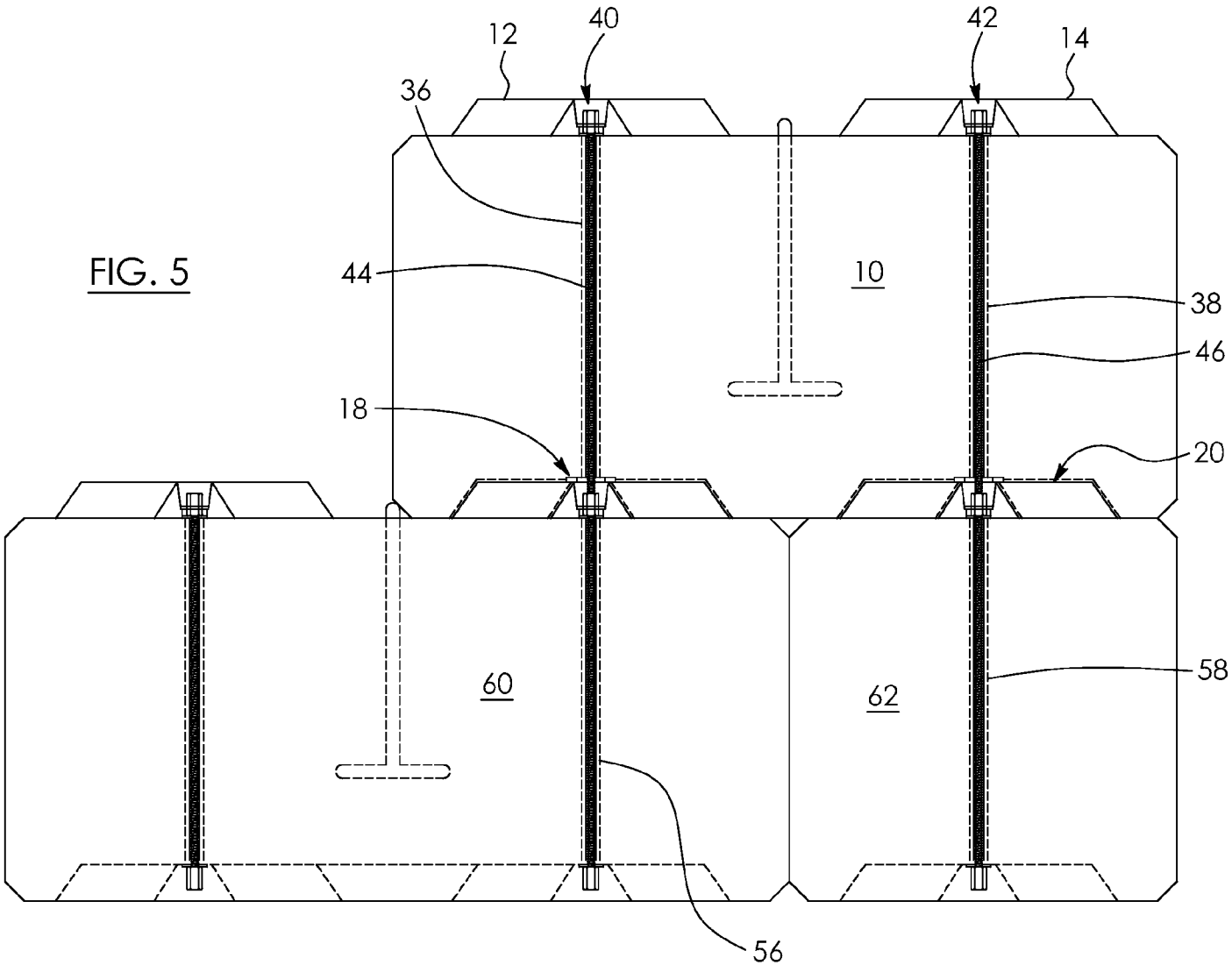
FIG. 5 is a sectional view showing the modular building block of FIG. 1 in a third course of a structure.

Referring to the drawings and first to FIG. 1 this shows an improved modular building block 10. The building block 10 has a pair of keys 12 and 14 on a first load-bearing surface 16 thereof and a pair of corresponding keyways 18 and 20 on a second load-bearing surface 22 thereof. The first load-bearing surface 16 is a top surface of the building block 10 and the second load-bearing surface 22 is a bottom surface of the building block 10. The keys and keyways are generally cross-shaped in this example as best shown in FIGS. 2 and 3. In this example, the keyways 18 and 20 also share a common leg 24 which extends between the keyways. The keys and keyways allow for inter-engagement of adjacent blocks as best shown in FIGS. 4 and 5.

Referring back to FIG. 1, the building block 10 is also provided with chamfers, for example chamfers 26, 28, 30 and 32, between adjacent perpendicular surfaces thereof. The chamfers may function to lessen damage to the building block 10 if the building block is handled roughly. In other examples however the building block may not be chamfered to minimize openings between adjacent building blocks where debris may collect or animals may nest. There is a lug 34 embedded in the building block 10 and extending from the first load-bearing surface 16. The lug 34 may facilitate lifting and mooring of the building block 10 by means of cables or chains. The lug 34 is received by the common leg 24 of the keyways in an adjacent building block when the building blocks are stacked. The building block, as thus far described, is accordingly conventional and similar to the type disclosed in U.S. Pat. No. 6,931,797 which issued to Drew on Aug. 23, 2005 and the full disclosure of which is incorporated herein by reference.

However, the building block 10 disclosed herein is further provided with hollows 36 and 38 extending between corresponding ones of the keys and keyways. More specifically the hollows 36 and 38 extend from the respective recesses 40 and 42 in the keys 12 and 14 to the corresponding keyways 18 and 20. The hollows 36 and 38 are configured to receive respective reinforcement rods 44 and 46 as best shown in FIGS. 4 and 5. When the building block 10 is disposed on a second course of a structure, as shown in FIG. 4, reinforcement rods 44 and 46 are coupled at the keyways 18 and 20 to respective anchors 48 and 50 which are embedded in foundation blocks 52 and 54 in a first course of the structure. When the building block 10 is disposed on a third or higher course of a structure, as shown in FIG. 5, the reinforcement rods 44 and 46 are coupled at the keyways to respective reinforcement rods 56 and 58 in blocks 60 and 62 on an immediately lower course.

Figure 6:
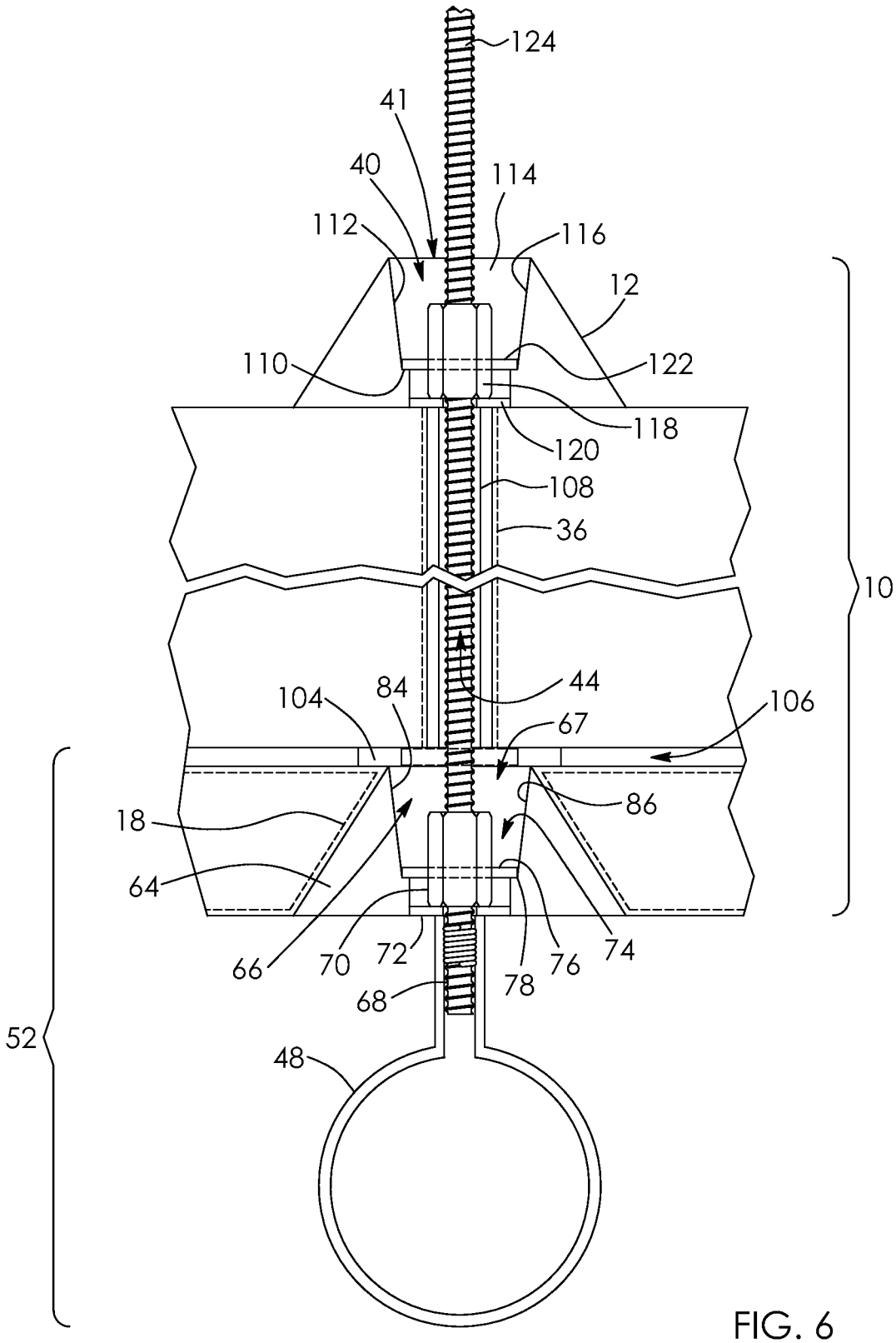
FIG. 6 is a fragmentary, sectional view showing the modular building block of FIG. 1 engaged and interlocked with a foundation block.

Coupling of one of the rods 44 and its corresponding anchor 48 is shown in greater detail in FIG. 6 with the understanding that the other one of the rods 46 is coupled to its corresponding anchor 50 in a substantially similar manner using substantially similar components. A key 64 of the foundation block 52 engages the keyway 18 in the building block 10. There is a recess 66 in the key 64 of the foundation block 52 and the anchor 48 is embedded adjacent to the recess 66. In this example, the anchor 48 is a coil loop anchor which is in communication with the recess 66 in the key 64 of the foundation block 52. A threaded member 68 threadedly engages the anchor 48 and a coupling 70. The reinforcement rod 44 of the building block 10 also threadedly engages the coupling 70 and is thereby coupled to the anchor 48. There is a flange 72 which is welded to the coupling 70 in this example and functions as a washer for the coupling. There is also a locking mechanism 74 which includes a locking plate 76 and shoulder 78 disposed in the recess 66 in the key 64 of the foundation block 52. In this example, the shoulder 78 is the shape of a perimeter of a polygon.

Figure 7:
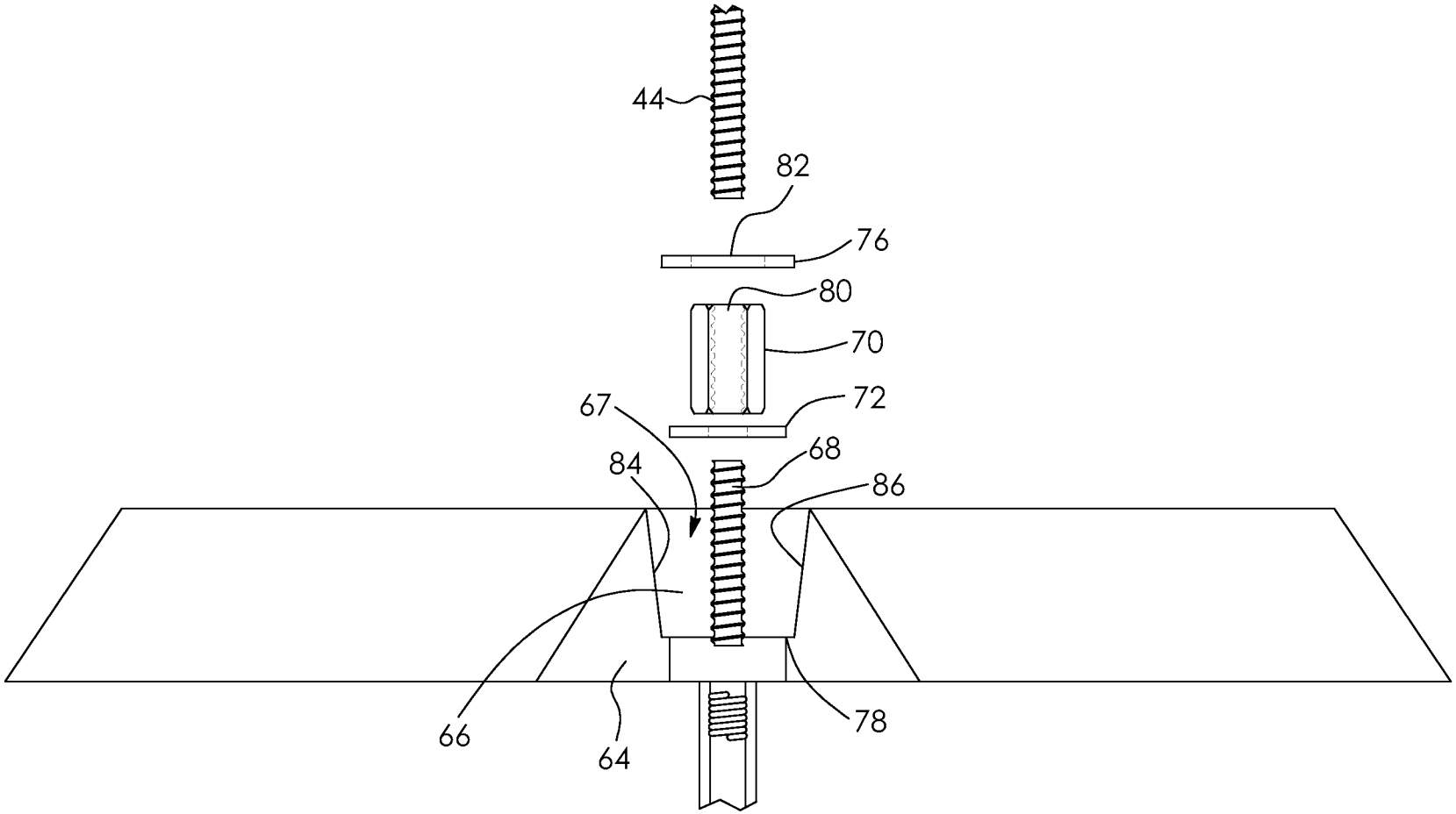
FIG. 7 is an exploded view showing a coupling and a locking mechanism of FIG. 6.

Referring now to FIG. 7, the coupling 70 has a polyhedron cross-section, hexahedron in this example, and a threaded opening 80 extending longitudinally therethrough. The locking plate 76 is square in this example and has a central opening 82 that is configured to receive the coupling 70 and prevent rotation of the coupling relative to the locking plate, i.e. in this example the central opening in the locking plate is a hexagon. Referring back to FIG. 6 the locking plate 76 sits on the shoulder 78 in the recess 66 in the key 64 of the foundation block 52. The shoulder 78 has a square perimeter and side walls of the recess 66, for example walls 84 and 86, extend from the shoulder 78 to a mouth 67 of the recess. Rotation of the locking plate 76 is accordingly prevented when the locking plate 76 is seated on the shoulder 78. Rotation of the coupling within the recess 66 is also prevented since the coupling 70 is not able to rotate relative to the locking plate 76. Preventing rotation of the coupling 70 is desirable because rotation may cause the coupling 70 and the reinforcement rod 44 to unthread, thereby diminishing reinforcement capacity of the reinforcement rod.

Figure 8:
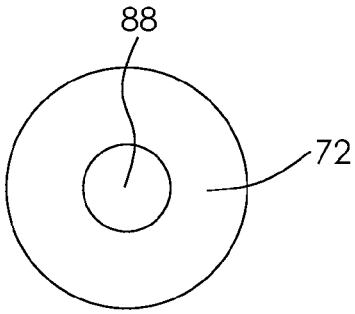
FIG. 8 is a plan view of a flange of the coupling of FIG. 7.
Figure 9:
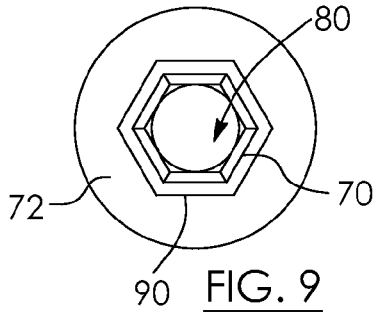
FIG. 9 is a plan view of the flange and the coupling of FIG. 7.
Figure 10:
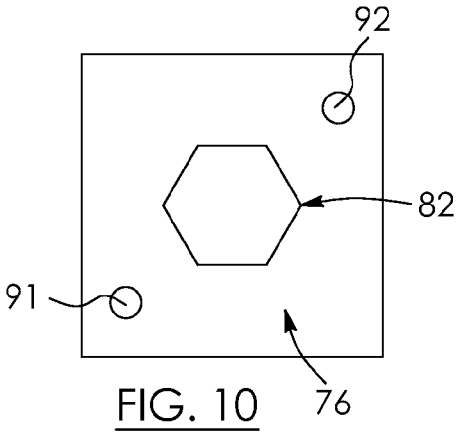
FIG. 10 is a plan view of a locking plate of the locking mechanism of FIG. 7.
Figure 11:
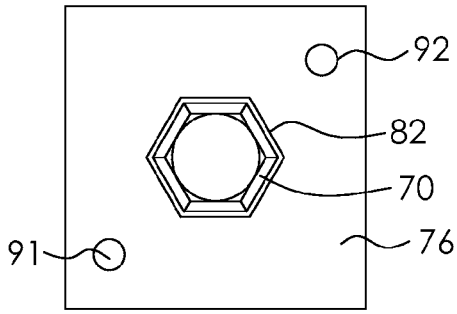
FIG. 11 is a plan view of the coupling and the locking plate of FIG. 7.
Figure 12:
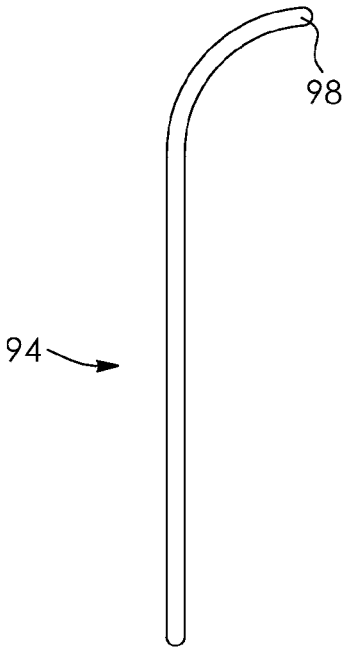
FIG. 12 is an elevation view of a tool used to set or remove the locking plate of FIG. 7.
Figure 13:
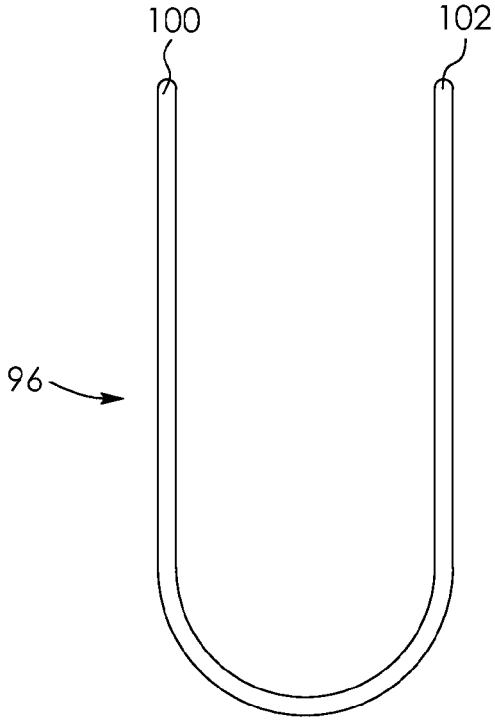
FIG. 13 is an elevation view of a tool used to set or remove the locking plate of FIG. 7.

The flange 72 is best shown in FIG. 8 and includes a central opening 88 to allow the threaded member 68 to pass through the flange 72 and into the coupling 70 as shown in FIG. 6. In this example the flange 72 is welded to the coupling 70 by welds 90 as best shown in FIG. 9. The locking plate 76 and central opening 82 thereof are best shown in FIG. 10. The coupling 70 is received by the central opening 82 of the locking plate 76 as best shown in FIG. 11. The locking plate 76 also includes peripheral openings 91 and 92 which are used to set or remove the locking plate during construction of a structure. A hooked removal tool 94, shown in FIG. 11, or a U-shaped removal tool 96, shown in FIG. 12, may be used to engage the peripheral openings 91 and 92 and move the locking plate during setting or removal of the locking plate. A hooked end 98 of the hooked removal tool 94 may be used to engage either of the peripheral openings 91 and 92 of the locking plate 76 to guide movement of the locking plate 76 in the recess of the key. Alternatively, remote ends 100 and 102 of the U-shaped removal tool 96 may be used to engage respective ones of the peripheral openings 91 and 92 of the locking plate 76 to guide movement of the locking plate 76 in the recess of the key.

Referring back to FIG. 6, in this example, there is also a gasket 104 between the foundation block 52 and the building block 10. The gasket 104 is used to create a drainage gap 106 between the blocks and seals the reinforcement rod 66 in the foundation block 52. The reinforcement rod 44 extends from the coupling 70 in the recess 66 in the key 64 of the foundation block 52, through the hollow 36 in the building block 10, to the recess 40 in the key 12 of the building block. There may be a cylindrical sleeve 108 in the hollow 36 to partially encase the reinforcement rod 44. The sleeve 108 may be filled with waterproof grease to minimize corrosion of the reinforcement rod 44.

Figure 14:
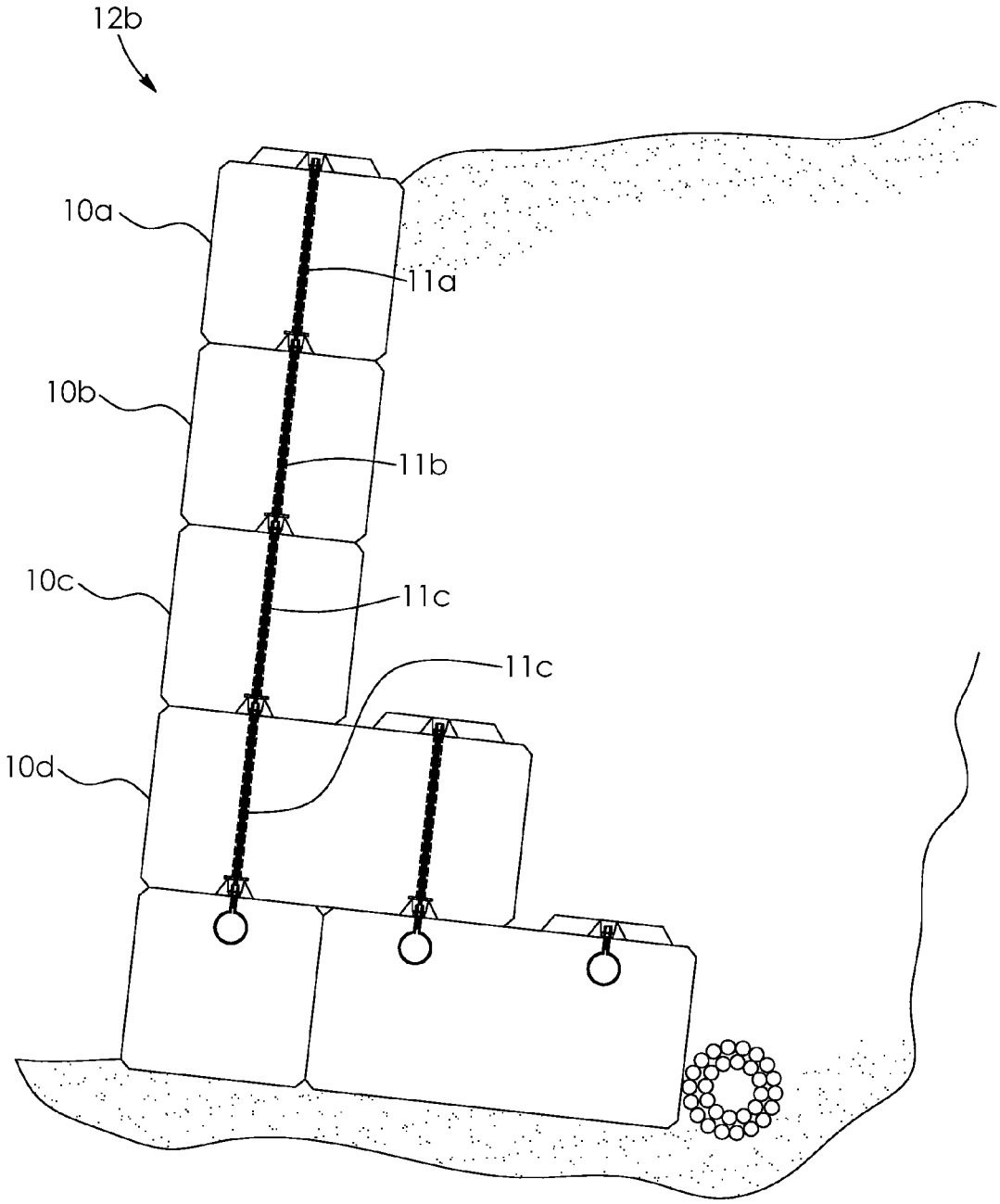
FIG. 14 is a sectional view of a retaining wall constructed using the modular building block of FIG. 7.

The configuration of the recess 40 in the key 12 of the building block 10 is substantially identical to the configuration of the recess 66 in the key 64 of the foundation block 52. There is shoulder 110 with a square perimeter disposed in the recess 40 and side walls of the recess, for example side walls 112, 114 and 116, extend from the shoulder to a mouth 41 of the recess. The reinforcement rod is able to threadedly engage a coupling 118 in the recess 40. The coupling 118 is substantially identical to the above described coupling 70 and is also provided with a flange 120 which functions as a washer. A locking plate 122 which is substantially identical to the above described locking plate 76 may be used to prevent rotation of the coupling 118 in the recess 40. A reinforcement rod 124 of another building block (not shown) may then threadedly engage the coupling 118 to couple the reinforcement rods 44 and 124 during the construction of a structure, for example a retaining wall 126 as shown in FIG. 14, in which a plurality of building blocks 10*a*, 10*b*, 10*c* and 10*b* are inter-engaged at their keys and keyways as well as interlocked at points of connection of their reinforcement rods 11*a*, 11*b*, 11*c* and 11*d* as described above. Preventing rotation of the couplings which interlock the reinforcement rods prevents the reinforcement rods and couplings from unthreading. This is advantageous because unthreading of the reinforcement rods from the couplings may diminish the reinforcement capacity of the reinforcement rods.

It will be understood by a person skilled in the art that many of the details provided above are by way of example only, and are not intended to limit the scope of the invention which is to be determined with reference to the following claims.

What is claimed is:

1. A modular building block comprising:

a first load-bearing surface having a key;

a recess in the key, the recess having a shoulder disposed therein and side walls extending from the shoulder to a mouth of the recess;

a reinforcement rod extending into the recess and a coupling for connecting vertically aligned reinforcement rods disposed in the recess, the reinforcement rod threadedly engaging the coupling; and a locking plate engaging the coupling to prevent the coupling from rotating relative to the locking plate, wherein the locking plate sits on the shoulder and rotation of the locking plate within the recess is prevented by the side walls of the recess.

2. The modular building block as claimed in claim 1 further including a second load-bearing surface having a keyway, wherein the reinforcement rod also extends into the keyway.

3. The modular building block as claimed in claim 2 further including a hollow extending between the keyway and the recess in the key, wherein the reinforcement rod extends through the hollow.

4. The modular building block as claimed in claim 3 further including a sleeve in the hollow, wherein the reinforcement rod extends through the sleeve in the hollow.

5. The modular building block as claimed in claim 4 further including waterproof grease in the sleeve.

6. The modular building block as claimed in claim 1 wherein the locking plate includes a central opening for receiving the coupling.

7. The modular building block as claimed in claim 6 wherein the coupling is a polyhedron with a threaded aperture extending longitudinally therethrough and the central opening in the locking plate is a polygonal opening having the same number of sides as the coupling.

8. The modular building block as claimed in claim 7 wherein the coupling is a hexahedron and the central opening in the locking plate is a hexagon.

9. The modular building block as claimed in claim 6 further including a peripheral opening in the locking plate.

10. The modular building block as claimed in claim 1 wherein the shoulder is a perimeter of a polygon.

11. The modular building block as claimed in claim 10 wherein the locking plate is a polygon having the same number of sides as the shoulder.

12. The modular building block as claimed in claim 10 wherein the shoulder is square and the locking plate is square.

13. A structure comprising the modular building block of claim 1.

* * * * *